US012208947B2

(12) United States Patent
Remenda et al.

(10) Patent No.: US 12,208,947 B2
(45) Date of Patent: Jan. 28, 2025

(54) TWO-PIECE CHILD RESISTANT CONTAINER LID WITH PUSH-RELEASE LATCH ARRANGEMENT

(71) Applicants: Tobin Remenda, Westerose (CA); Catherine Anne-Marie Deslauriers, Westerose (CA)

(72) Inventors: Tobin Remenda, Westerose (CA); Catherine Anne-Marie Deslauriers, Westerose (CA)

( * ) Notice: Subject to any disclaimer, the term of this patent is extended or adjusted under 35 U.S.C. 154(b) by 47 days.

(21) Appl. No.: 17/532,048

(22) Filed: Nov. 22, 2021

(65) Prior Publication Data

US 2022/0194672 A1 Jun. 23, 2022

Related U.S. Application Data

(60) Provisional application No. 63/118,710, filed on Nov. 26, 2020.

(51) Int. Cl.

| | |
|---|---|
| ***B65D 50/06*** | (2006.01) |
| ***B65D 50/04*** | (2006.01) |
| ***B65D 51/18*** | (2006.01) |

(52) U.S. Cl.

CPC ..... *B65D 50/045* (2013.01); *B65D 51/18* (2013.01); *B65D 2251/0006* (2013.01); *B65D 2251/0093* (2013.01)

(58) Field of Classification Search

CPC ..... B65D 51/18; B65D 51/20; B65D 50/045; B65D 50/066; B65D 2251/0093; B65D 41/026; B65D 41/62; B65D 55/02; B65D 55/08; B65D 55/0863

USPC ..... 220/345.5, 780, 783, 351; 215/305, 322

See application file for complete search history.

(56) References Cited

U.S. PATENT DOCUMENTS

| | | | | |
|---|---|---|---|---|
| 4,176,756 | A * | 12/1979 | Gellman | B65D 51/002 403/309 |
| 4,241,188 | A * | 12/1980 | Materia | C12M 29/20 435/317.1 |
| 4,271,972 | A * | 6/1981 | Thor | B65D 55/02 215/253 |
| 4,286,640 | A * | 9/1981 | Knox | A61J 1/1425 604/404 |

(Continued)

FOREIGN PATENT DOCUMENTS

DE 202012006437 U1 * 9/2012 ..... B65D 41/0485

*Primary Examiner* — Allan D Stevens

(74) *Attorney, Agent, or Firm* — Kyle R. Satterthwaite; Ryan W Dupuis; Ade & Company Inc.

(57) ABSTRACT

A child resistant lid features first and second lid components for covering respective fractions of a container opening. One or more latch arrangements releasably latch the components together in a closed state over the container opening, and each feature a latch hole defined in one of the components, and a latch tongue affixed to the other component. The tongue is sized and oriented to reach a position neighbouring the latch hole when said first and second lid components are mated together in the closed state. A catch button disposed on the latch tongue juts from a side thereof at a position that aligns with the latch hole in the closed state of the lid. The tongue is resiliently flexible in a bending direction, and resiliently biased into a default position that biases the catch button into the latch hole when the lid components are mated together.

22 Claims, 4 Drawing Sheets

(56) References Cited

U.S. PATENT DOCUMENTS

| | | | | |
|---|---|---|---|---|
| 4,377,245 | A * | 3/1983 | Patty | B65D 45/345 220/822 |
| 5,169,259 | A * | 12/1992 | Cornell, Jr. | A47B 91/024 403/309 |
| 6,227,975 | B1 * | 5/2001 | Smith | F16D 3/41 464/7 |
| 7,735,667 | B2 * | 6/2010 | Schutz | F16L 19/0231 215/276 |
| 7,770,853 | B2 * | 8/2010 | Shiffler | A47B 91/06 248/346.11 |
| 8,272,670 | B2 * | 9/2012 | Krug, Jr. | F16L 59/024 285/45 |
| 10,086,984 | B2 * | 10/2018 | Colangelo | B65D 47/36 |
| 11,523,970 | B1 * | 12/2022 | Vitello | A61J 1/1412 |
| 2007/0062903 | A1 * | 3/2007 | Norman | B65D 55/0863 215/901 |
| 2009/0120934 | A1 * | 5/2009 | Domkowski | A61J 1/1425 220/253 |
| 2022/0024651 | A1 * | 1/2022 | Yates | A61J 1/14 |

* cited by examiner

REPLACEMENT SHEET

TWO-PIECE CHILD RESISTANT CONTAINER LID WITH PUSH-RELEASE LATCH ARRANGEMENT

CROSS-REFERENCE TO RELATED APPLICATIONS

This application claims benefit under 35 U.S.C. 119(e) of U.S. Provisional Application No. 63/118,710, filed Nov. 26, 2020, the entirety of which is incorporated herein by reference.

FIELD OF THE INVENTION

The present invention relates generally to containers, and more particularly to child resistant lids.

BACKGROUND

As more jurisdictions legalize or decriminalize *cannabis* for medicinal and recreational use, there is an increased need for child resistant containers for safe storage of *cannabis*, in response to which applicant has designed the novel child-resistant lid disclosed herein. Though originally derived with *cannabis* products in mind, it will be appreciated that the inventive lid design disclosed herein may be applied to any variety of container applications where child-proofing may be necessary or desirable.

SUMMARY OF THE INVENTION

According to one aspect of the invention, there is provided a child resistant lid for a container, said lid comprising:

first and second lid components each sized to cover a respective fraction of an opening of said container, and movable relative to one another between a closed state in which said lid components are mated together to collectively define an combined lid structure sized to cover an entirety of said opening of the container, and an open state in which said lid components are drawn apart from one another to at least partially reveal said opening of the container for access to contents of said container;

one or more latch arrangements configured to releasably latch said first and second lid components together in the closed state, and each comprising:

a latch hole defined in a first one of either said first or second lid component; and a latch tongue affixed to a second one of either said first or second lid component and reaching outward therefrom in a protruding direction from an end thereof at which said first and second lid components mate together in the closed state, the latch tongue being sized and oriented to reach a position neighbouring said latch hole when said first and second lid components are mated together in the closed state;

a catch button disposed on said latch tongue and jutting from a side thereof at a position thereon that aligns with said latch hole in said closed state;

wherein said latch tongue is resiliently flexible in a bending direction that is transverse to said protruding direction, but matches a direction in which said latch opening opens through said first one of either said first or second lid component, said latch tongue being resiliently biased into a default position that biases said catch button into the latch hole when the first and second lid components are mated together.

BRIEF DESCRIPTION OF THE DRAWINGS

Preferred embodiments of the invention will now be described in conjunction with the accompanying drawings in which.

DETAILED DESCRIPTION

Figure 1:
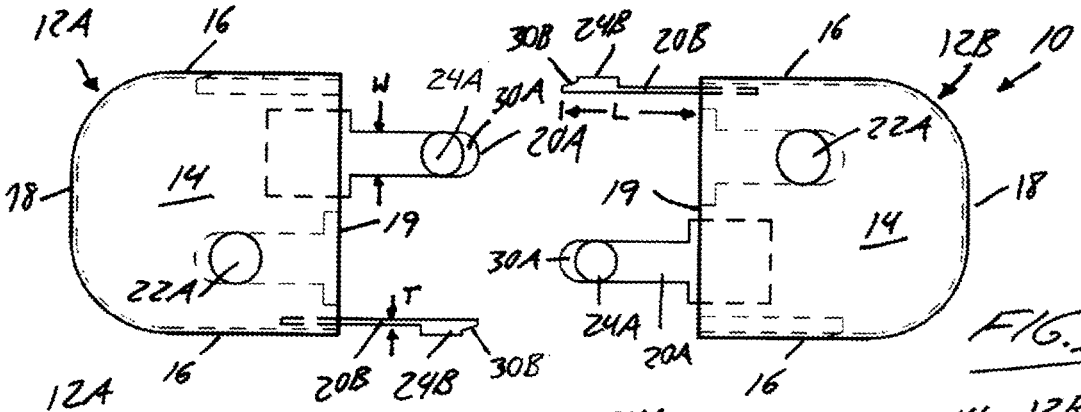
FIG. 1 is an exploded top plan view of a child resistant lid of a first embodiment for use on a rectangular tin or container.
Figure 2:
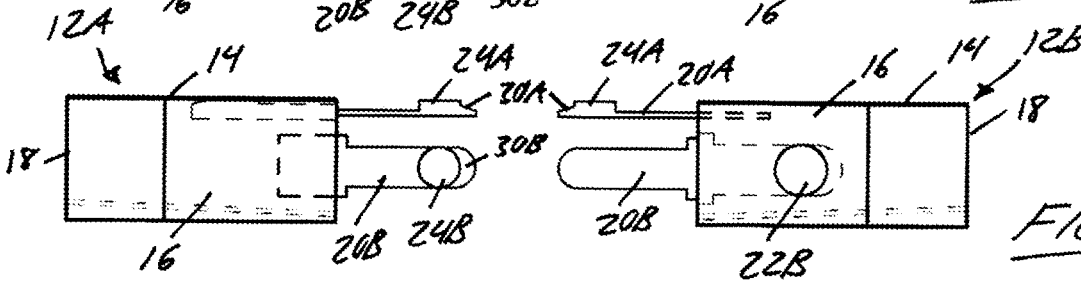
FIG. 2 is an exploded side elevational view of the lid of FIG. 1.
Figure 3:
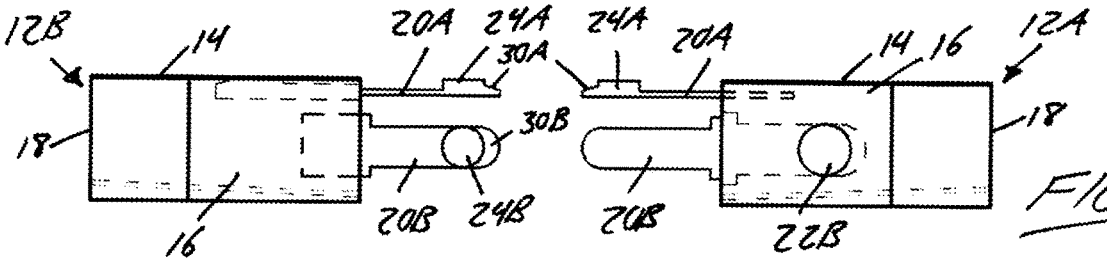
FIG. 3 is another exploded side elevational view of the lid of FIG. 2, but from an opposing side thereof.
Figure 4:
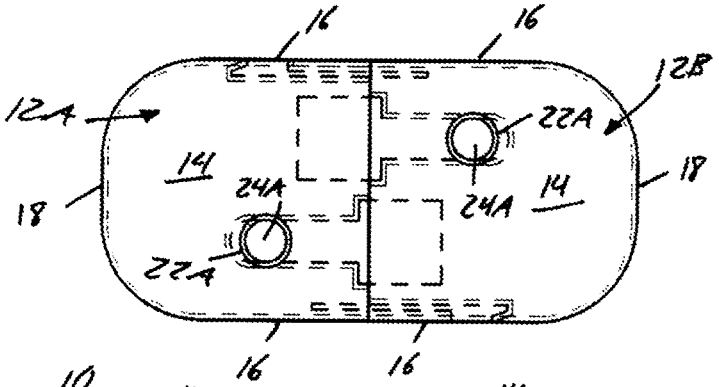
FIG. 4 is an assembled top plan view of the lid of FIG. 1.

FIGS. 1 through 8 illustrate a first embodiment of a two-piece, child-resistant lid 10 designed for use on a generally rectangular tin 100, such as those in which anchovies are typically packaged, distributed and sold in grocery stores. The lid 10 is composed of two separate but identical lid components 12A, 12B void of any permanent attachment therebetween, but which are designed to be selectively slid together into a mated state with one another from opposing ends of the rectangular tin 100 and latched together in order to cooperatively close off the open top of the tin. Mated together in a closed position atop the tin, each component covers a respective half of the tin's open top, and the two mated-together components thereby collectively form an assembled lid structure closing off the entirety of the tin's open top. One or more latch arrangements, and more particularly a plurality of such latch arrangements in the illustrated embodiments, are configured to automatically engage upon mating of the two lid components together. Separation thereof is prevented until a particular user-action is performed on each latch arrangement to release the latching function thereof and enable the two components to be pulled apart to reveal the tin's open top and enable access to the tin's contents. The preferred embodiments employ multiple latch arrangements laid out in a manner requiring use of multiple digits and both hands, to simultaneously release all the latch arrangements. This requires manual dexterity beyond that possessed by most, if not all, young children, thereby achieving child-proof, or at least child resistant, functionality.

Each lid component 12A, 12B has a shell composed of a generally rectangular top wall 14 and a series of perimeter walls depending downward therefrom on three sides of the top wall's four-sided perimeter. These perimeter walls include two opposing side walls 16, and a connecting wall 18 that joins together the two side walls 16. A fourth perimeter edge 19 of the top wall lacks a corresponding perimeter wall hanging downward therefrom, and is thus referred to herein as an "unwalled" perimeter edge 19 of the top wall 14. This unwalled perimeter edge 19 is coplanar with ends of the side walls 16 in a shared reference plane that is normal to the plane of the top wall 14, and denotes an inner end of the lid component 12A, 12B for mating abutment against the matching inner end of the other lid component. The connecting wall 18 resides at an opposing outer end of the lid component. In the illustrated example, the perimeter of the top wall 14 is notably rounded at the two corners of the outer end in order to conform to the rounded-corner rectangular shape of a conventional anchovy tin, though it will be appreciated that the corners may be less rounded in variants being used on a more square-cornered tin. As is clearly visible in the drawings, a height of each perimeter wall is lesser than both a length of the lid component, as measured from the connecting wall to the unwalled perimeter edge, and a width of the lid component, as measured between the two side walls.

Each lid component 12A, 12B features an upper latch tongue 20A that is attached to an underside of the top wall 14. This upper latch tongue 20A reaches outwardly from the inner end of the lid component in a protruding direction perpendicular to the unwalled perimeter edge 19. Each lid component 12A, 12B also features a lateral latch tongue 20B that is instead attached to one of the lid component's two side walls 16 at an inner side thereof that faces the other side wall. This lateral latch tongue 20B likewise reaches outwardly from the inner end of the lid component in the same protruding direction at the upper latch tongue 20A. Each tongue 20A, 20B has a length dimension L that is greatest of its three dimensions and is measured in the protruding direction from the inner end of the lid component, a width dimension W that is lesser than its length dimension and is measured perpendicularly thereof, and a thickness dimension T that is the least of its three dimensions and is measured perpendicularly of the other two.

The upper latch tongue 20A has its width orientated parallel to the unwalled perimeter edge 19 of the top wall 14, and its thickness oriented normal to the plane of the top wall 14. The lateral latch tongue 20B, relative to the upper latch tongue, resides in an orientation rotated ninety degrees about a lengthwise axis of the tongue, such that the width of the lateral latch tongue is oriented perpendicular to the unwalled perimeter edge 19 of the top wall 14 and parallel to a height of the side wall 16 that's measured normally of the plane of the top wall 14. The thickness of the lateral latch tongue 20B thus lies parallel to the width of the upper latch tongue 20A. Each latch tongue 20A, 20B is resiliently flexible to allow temporary bending thereof under exertion of forces thereon in a bending direction parallel to its thickness. In a default unbent position into which the tongue is resiliently biased, it lies in a plane generally parallel to that of the respective wall 14, 16 to which it is attached and from which it extends at the inner end of the lid component.

Each latch tongue 20A, 20B cooperates with a respective latch hole 22A, 22B defined in the lid component opposite that from which the tongue extends. The latch tongue and respective latch hole cooperatively form a respective latching arrangement. Each lid component 12A, 12B thus features an upper latch hole 22A penetrating through the top wall 14 thereof, and a lateral latch hole 22B penetrating through the side wall 16 opposite that from which the lateral latch tongue 20B of that lid component extends. Each latch tongue 20A, 20B, near a distal end thereof furthest from the unwalled perimeter edge of the top wall of the lid component from which it extends, has a respective catch button 24A, 24B jutting from an outer side of the tongue that faces the respective latch hole in the other lid component when the two lid components are mated together. The catch button 24A of the upper latch tongue 20A (the "upper catch button") of each lid component thus resides at the topside thereof that faces the upper latch hole 22A in the other lid component when the two are mated together. The catch button 24B on the lateral latch tongue 20B (the "lateral catch button") of each lid component resides on the laterally outer side thereof that faces away from the opposing side wall 16 of that lid component. Accordingly, when the two lid components are mated together at their inner ends, the lateral catch button 24B of each lid component will face the lateral latch hole 22B of the other lid component. Each catch button 24A, 24B is centered widthwise on the respective latch tongue, i.e. so that a center point of the catch button resides on a central lengthwise axis of the tongue.

The distance from a center point of the upper latch hole 22A to the nearest side wall 16 of the lid component matches a distance measured from the opposing side wall 16 to the lengthwise central axis of the same lid component's upper latch tongue 20A. A distance from the center point of the upper latch hole 22A to the unwalled perimeter edge 19 of the lid component matches a distance measured from the unwalled perimeter edge 19 of the lid component to the center point of that lid component's upper catch button 24A. As a result, the upper latch hole 22A in one lid component aligns with and receives the upper catch button 24A on the latch tongue of the other lid component when the two lid-components are mated together at their inner ends.

Similarly, an elevation at which the center point of the lateral latch hole 22B resides on the respective side wall 16 of the lid component matches the elevation on the opposing side wall at which the central lengthwise axis of the lateral latch tongue 20B resides, and a distance from the center point of the lateral latch hole 22B to the inner end of the lid component matches a distance measured from the inner end of the lid component to the center point of that lid component's lateral catch button 24B. As a result the lateral latch hole 22B in one lid component aligns with and receives the lateral catch button 24B on the lateral latch tongue of the other lid component when the two lid-components are mated together at their inner ends. Such mating together of the two lid components defines a closed state thereof in which they cooperatively define a combined lid structure closing an entirety of the tin's open top. In this state, receipt of the upper catch button 24A of each lid component in the upper latch hole 22A of the other lid component, and likewise the receipt of the lateral catch button 24B of each lid component in the lateral latch hole 22B of the other lid component, latches the two lid components together and prevents them from being pulled apart.

To release this latching function and enable separation of the two lid components into an open state withdrawn from one another to at least partially reveal the open top of the tin, the user must simultaneously depress the two catch buttons 24A, 24B on the two latch tongues 20A, 20B of each lid component 12A, 12B through the two latch holes 22A, 22B in the other lid component, which holes are sufficiently sized to accommodate such fingertip depression of the catch buttons through said holes. This denotes a total of four simultaneous button depressions using the fingertips of four digits, two from each of the user's two hands. Such depression of each catch button applies a force to the respective latch tongue in the aforementioned bending direction thereof, thus temporarily and resiliently bending the latch tongue into a flexed position withdrawing the depressed catch button 24A, 24B from the respective latch hole 22A, 22B and allowing the two lid components to be pulled apart.

Figure 5:
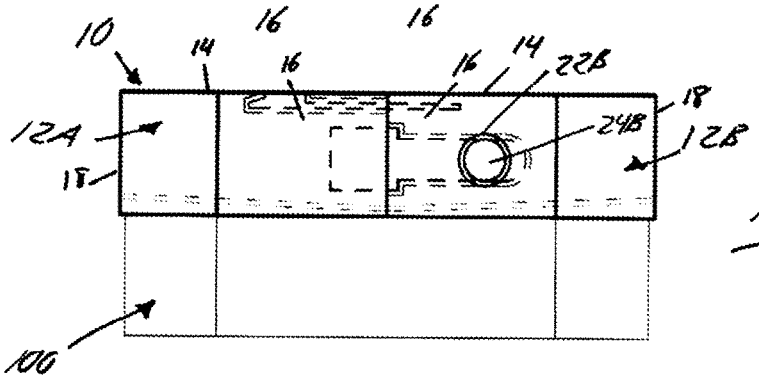
FIG. 5 is an assembled side elevational view of the lid of FIG. 4, installed in a closed position atop a rectangular tin.
Figure 6:
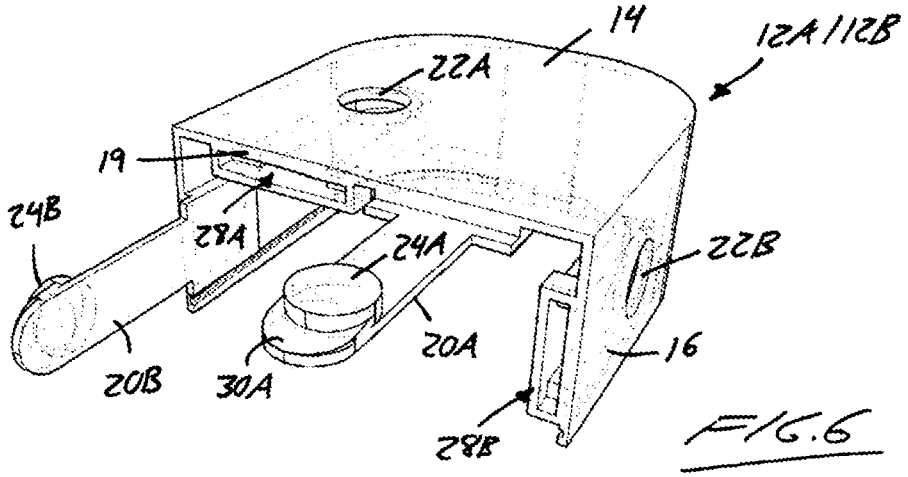
FIG. 6 is a top perspective view of one of two identical lid components of the lid of FIG. 1.
Figure 7:
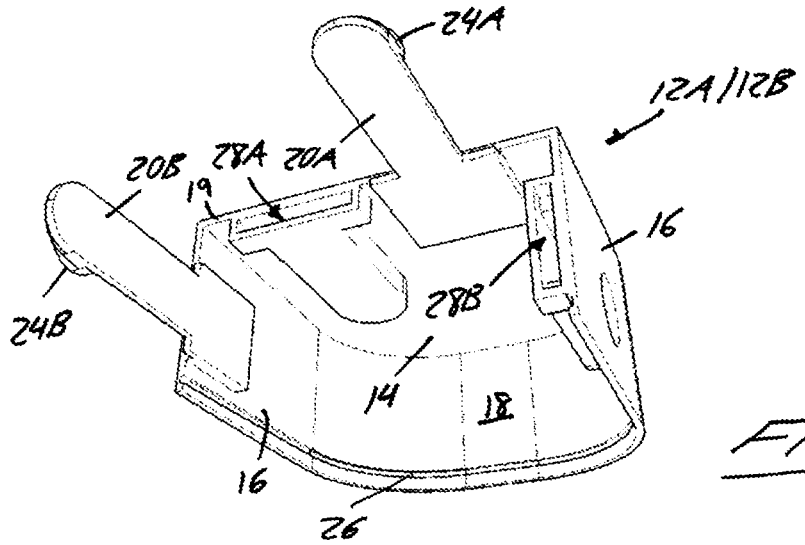
FIG. 7 is a bottom perspective view of the lid component of FIG. 6.
Figure 8:
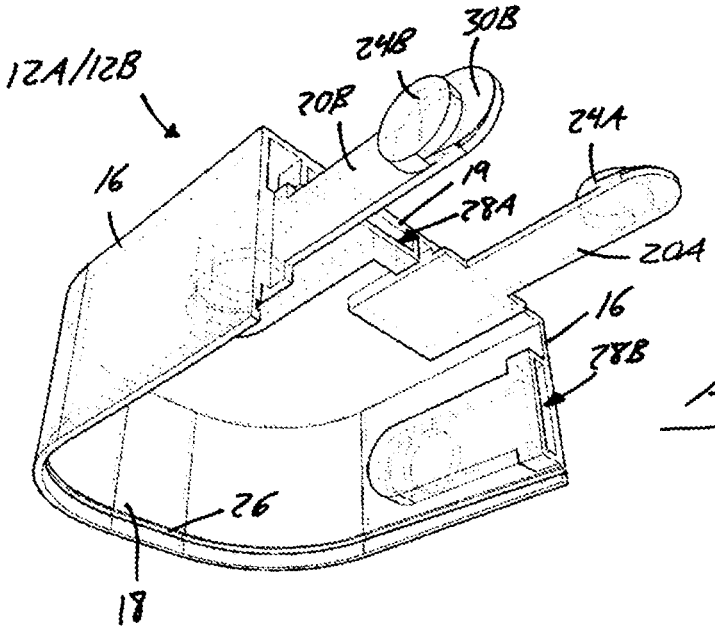
FIG. 8 is another bottom perspective view of the lid component of FIG. 7.
Figure 9:
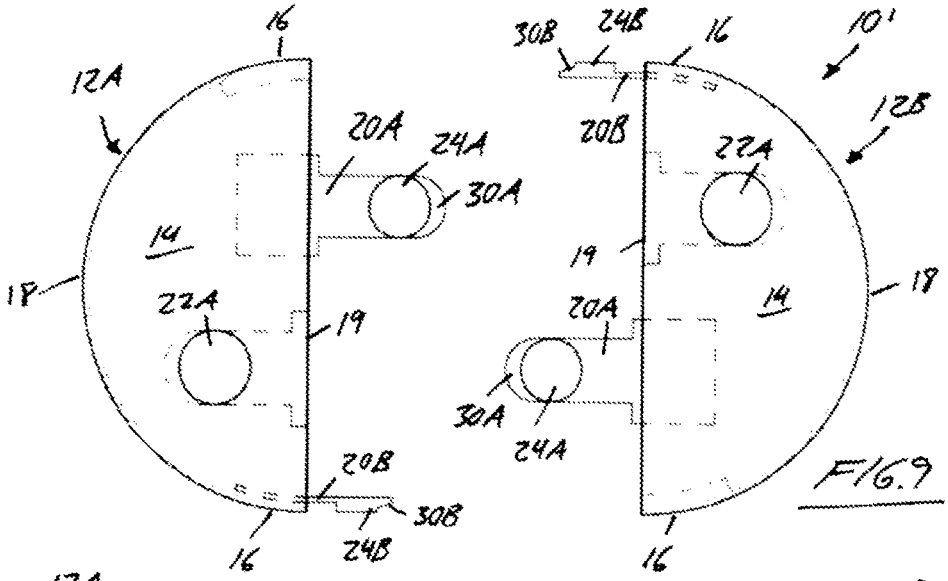
FIG. 9 is an exploded top plan view of a child resistant lid of a second embodiment for use on a round tin or container.
Figure 10:
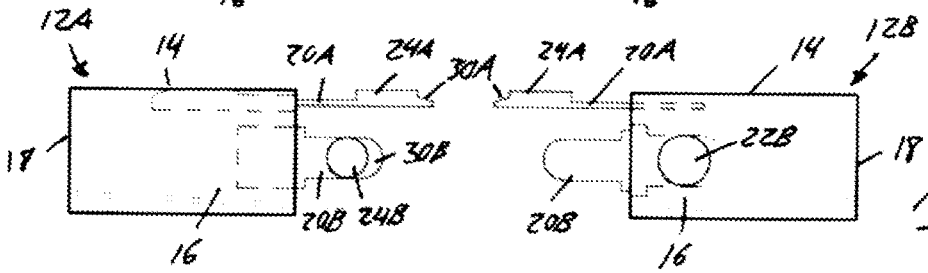
FIG. 10 is an exploded side elevational view of the lid of FIG. 9.
Figure 11:
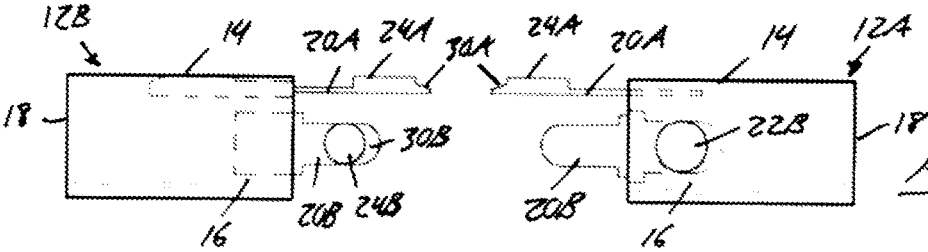
FIG. 11 is another exploded side elevational view of the lid of FIG. 10, but from an opposing side thereof.
Figure 12:
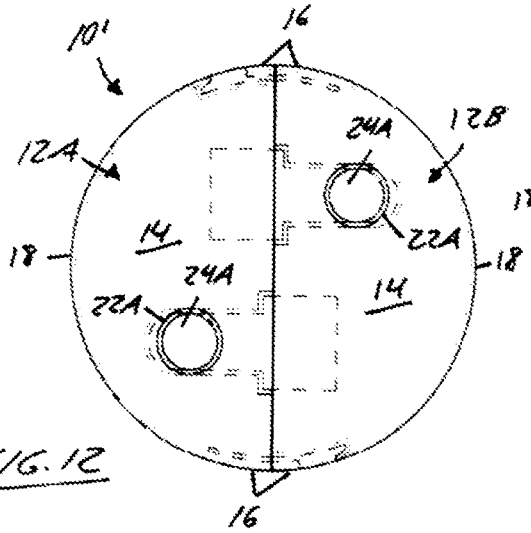
FIG. 12 is an assembled top plan view of the lid of FIG. 9.
Figure 13:
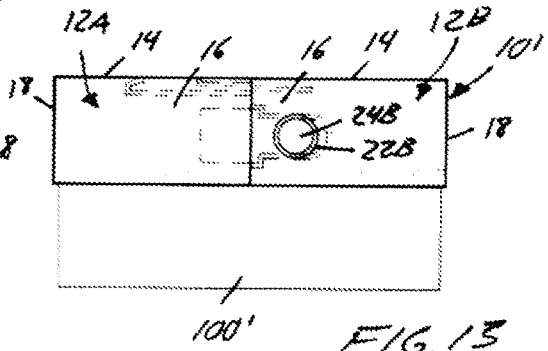
FIG. 13 is an assembled side elevational view of the lid of FIG. 12, installed in a closed position atop a round tin.
Figure 14:
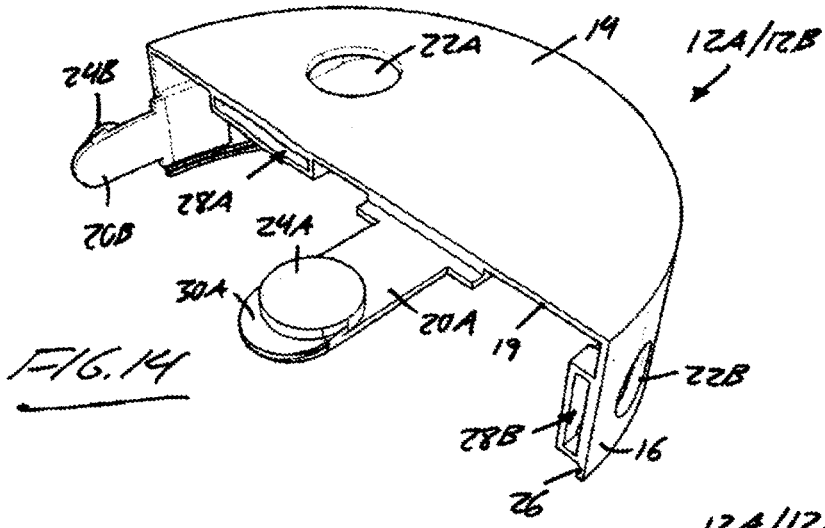
FIG. 14 is a top perspective view of one of two identical lid components of the lid of FIG. 9.
Figure 15:
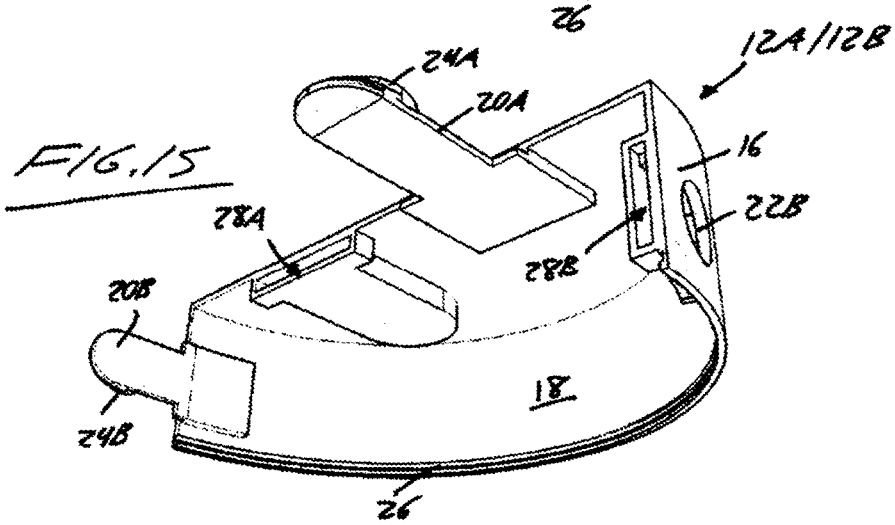
FIG. 15 is a bottom perspective view of the lid component of FIG. 6.
Figure 16:
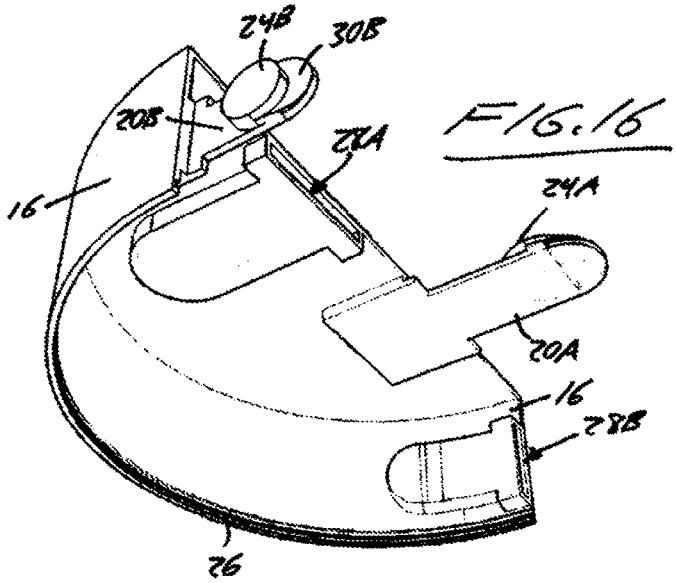
FIG. 16 is another bottom perspective view of the lid component of FIG. 15.

Referring to FIGS. 6 through 8, each lid component 12A, 12B features a groove 26 spanning fully around the perimeter walls 16, 18 at the inner sides thereof at a short elevation above the coplanar bottom edges of these perimeter walls, such that an entirety of the groove resides closer to the open bottom of the lid component than to the top wall thereof, and resides, again in its entirety, within an elevational range delimited between the open bottom of the lid component and the elevation at which the lateral latch tongue and lateral latch hole reside. The groove is dimensioned to for sliding receipt of an outer lip of a rolled upper rim the tin 100, which spans around and delimits the tin's open top. So, to install and close the lid 10, the two lid components are placed at opposing ends of the tin at an elevation aligning the groove 26 with the outer lip of the tin 100. The lid components are then slid together along this outer lip of the tin until the inner ends of the two lid components abut one another at a lengthwise midpoint of the tin, as shown in FIG. 5. Upon such mating of the lid components' inner ends, the two catch buttons 24A, 24B on the two latch tongues 20A, 20B of each lid component will automatically pop into the two latch holes 22A, 22B of the other lid component, thereby latching the two lid components together in the closed state fully spanning and covering the entirety of the tin's open top. The latched-together relationship between the two lid components prevents them from being pulled apart, until all four catch buttons are simultaneous depressed through the four latch holes. Meanwhile, the captured state of the tin's outer lip in the grooves 26 of the two lid components prevents lifting of the latched-together lid components from off the tin. The mated together lid components thus form a child proof, or at least child-resistant, lid structure atop the tin 100.

Referring still to FIGS. 6 through 8, the underside of the top wall 14 has affixed thereto an upper guide channel 28A that runs from the unwalled perimeter edge 19 of the top wall 14 to the upper latch hole 22A. The upper latch hole 22A thus opens through the top wall 14 into the upper guide channel 28A. The side wall 16 with the lateral latch hole 22B likewise has a lateral guide channel 28B affixed to the inner side of the wall. Like this upper guide channel, this lateral guide channel 28B likewise runs from the inner end of the lid component to the lateral latch hole 22B. The lateral latch hole 22B thus opens through the side wall 16 into the lateral guide channel 28B.

A vertical height of the upper guide channel slightly exceeds the combined thickness of the upper latch tongue 20A and upper catch button 24A, but the elevation at which the top boundary of the channel (i.e. the underside of the top wall 14) resides is slightly lower than that occupied by the top of the upper catch button 24A in the normal default position of the upper latch tongue 20A. Accordingly, insertion of the upper latch tongue 20A into the upper guide channel 28A requires a slight downward deflection of the upper latch tongue 20A in the bending direction. To encourage such deflection, a distal portion of the upper latch tongue 20A is tapered to reduce in thickness from the upper catch button 24A to the distal end of the upper latch tongue 20A. This taper creates an angled ramp surface 30A on the topside of the upper latch tongue. During insertion of the upper latch tongue 20A of each lid component into the upper guide channel 28A of the other lid component, this ramp surface 30A slides in interfering fashion against the unwalled perimeter edge 19 that defines the upper boundary of the opening to the guide channel 28A. This sliding interference causes a downward deflection of the upper latch tongue 20A. The deflected latch tongue 20A slides onward through the guide channel 28A until the two lid components are fully mated, denoting that the upper catch button 24A has reached the upper latch hole 22A, whereupon the resilient latch tongue 20A flexes back up into its default position, thus popping the upper catch button 24A up into the upper latch hole 22A.

Similarly, a horizontal width of the lateral guide channel 28B slightly exceeds the combined thickness of the lateral latch tongue 20B and lateral catch button 24B, but the lateral distance at which the outer boundary of the channel (i.e. the inner side of the side wall 16) resides from a midplane of the lid component is slightly lesser than the lateral distance at which the outer face of the lateral catch button 24B resides from this midplane in the normal default position of the lateral latch tongue 20B. Accordingly, insertion of the lateral latch tongue 20B into the lateral guide channel 28B requires slightly inward deflection of the lateral latch tongue 20B in the bending direction. To encourage such deflection, a distal portion of the lateral latch tongue 20B is tapered to reduce in thickness from the lateral catch button 24B to the distal end of the lateral latch tongue 20B, and to thereby create an angled ramp surface 30B on the outside of the lateral latch tongue. During insertion of the lateral latch tongue 20B of each lid component into the lateral guide channel 28B of the other lid component, this ramp surface 30B slides in interfering fashion against the end of the side wall 16 that defines the outer boundary of the opening to the guide channel 28B. This sliding interference causes the inward deflection of the lateral latch tongue 20B. The deflected latch tongue 20B slides onward through the guide channel 28B until the two lid components are fully mated, denoting that the lateral catch button 24B has reached the lateral latch hole 22B, whereupon the resilient latch tongue 20B flexes back out into its default position, thus popping the lateral catch button 24B outwardly into the lateral latch hole 22B.

The first embodiment lid 10 described above and illustrated in FIGS. 1 through 8 is shaped particularly for use on a generally rectangular tin, whereby the two lid components are generally rectangular in shape (though optionally with notably rounded corners at the outer end as shown, depending on the shape of the tin). When combined, the lid components collectively form an overall lid structure of larger, but still generally rectangular, form. A second embodiment lid 10' shown in FIGS. 9 through 16 has same described layout of two identical lid components each with an upper latch tongue, upper latch hole, upper catch button, upper guide channel, lateral latch tongue, lateral latch hole, lateral catch button, and lateral guide channel. The second embodiment differs only in that the shell of each lid component is semi-circular in shape, whereby the two lid components collectively form a circular lid structure when mated together for use on a round tin 100', such as that in which canned tuna fish is normally packaged, distributed and sold in grocery stores. The side wall 16 at which the lateral latch hole 22B and cooperating lateral guide channel 28B of each lid component reside is therefore a curved portion of a continuously curved 180-degree perimeter wall structure, rather than a flat wall section of a multi-sectioned perimeter wall structure having multiple flat walls, with optionally rounded transition walls therebetween. The second embodiment lid 10' is otherwise the same in structure and function as the first embodiment, and is accordingly labeled with matching reference numbers, without reproducing the detailed description of its common features from the earlier embodiment.

Though the illustrated embodiments denote use on a rectangular anchovy tin and round tuna fish tin, it will be appreciated that the container may be of any particular open-topped container on which the two lid components may be slid together from opposing ends or sides thereof, regardless of whether that container is of a metal tin construction. The container may instead be formed of molded or 3D printed plastic, or may be otherwise constructed or fabricated with any variety of different possible material compositions. In relation to this, the channel 26 on the inside of the perimeter wall structure of each lid component may receive any sort of outwardly protruding lip on the outer perimeter of the tin or container, whether this lip is part of a roll-formed rim of a metal tin specifically bounding the open top of the tin. Alternatively, this outer lip may be formed in another manner (e.g. molded, 3D printed), and optionally situated at a lower elevation further down the perimeter wall structure of the container.

The lid components 12A, 12B are preferably of plastic composition to provide the described resilient flexibility of the latch tongues, and may produced by way of plastic molding techniques, or 3D printing. While the illustrated embodiment uses two identical lid components, each having two latch tongue and two latch holes, of which one latch tongue and one latch hole are situated at the top wall of the shell, and with the other latch tongue and latch hole situated at opposing side walls of the shell, the particular number and layout of latching arrangements may be varied, and the two lid components need not be identical, and at least in the case of a rectangular tin, the two lid components also need not necessarily be equally sized to cover equal 50% fractions of the container's open top. In the mated-together closed state of the lid components, the two upper latching arrangements formed by the two upper latch tongues and two upper latch holes may be characterized as "matching" latch arrangements, in that they both reside at matching walls (the top wall) of the two lid components. On the other hand, the two lateral latching arrangements formed by the two lateral latch tongues and two lateral latch holes may be characterized as "opposing" latching arrangements, in that they reside at opposing side walls of the two mated-together lid components.

As shown in the drawings, the groove 26 of each may reside in an inclined plane relative to the bottom plane of the lid component, specifically in a plane that slopes upwardly toward the outer end of the lid component. To maintain a freshness of its contents, the container may have a thin cover sheet of polymeric film or other substantially air impermeable material sealed to the rim of the container during commercial packing thereof. Typically, when the cover is sealed to the container at the packing facility, the sliding of the two lid components together will not disrupt the position of the cover or sacrifice the cover's integrity. The end user of the container, after an initial use in which the packager-installed cover is removed, may wish to place the removed cover back atop the container rim to continue to best maintain the freshness of the remaining product inside the container. Here, where the cover is no longer factory sealed to the rim of the container, the inclined orientation of the grooves 26 in the lid components allow the two lid components to be slid together over the loosely placed cover without disrupting the position thereof, and only at the last stage of engagement between the two lid components will they snap down atop the container rim to create downpressure on the loosely placed cover, thus re-establishing a seal between the cover and the container rim.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A child resistant lid and container, said lid comprising:

two separate lid components void of any permanent attachment therebetween but selectively latchable together to cooperatively form said child resistant lid, and each sized to cover a respective fraction of an opening of said container, and movable relative to one another between a closed state in which said separate lid components are mated together to collectively define a combined lid structure sized to cover an entirety of said opening of the container, and an open state in which said separate lid components are drawn apart from one another to at least partially reveal said opening of the container for access to contents of said container, each lid component comprising a top wall that resides oppositely of an open bottom of the lid component and from which a plurality of perimeter walls depend downwardly from a perimeter of said top wall, said perimeter walls including two opposing side walls and a connecting wall spanning therebetween, said perimeter walls collectively spanning an entirety of said perimeter of the top wall, except at a singular unwalled perimeter edge thereof that resides oppositely of the connecting wall and spans fully across the lid component at an inner end thereof, where said unwalled perimeter edge interconnects said two opposing side walls at terminals ends thereof furthest from the connecting wall;

a plurality of latch arrangements configured to releasably latch said separate lid components together in the closed state, said plurality of latch arrangements including:

an upper latch arrangement comprising:

an upper latch hole penetrating through a first one of the top walls; and an upper latch tongue affixed to a second one of the top walls and reaching outward from the unwalled perimeter edge thereof in a protruding direction from the inner end of the lid component at which said separate lid components mate together in the closed state, the upper latch tongue being sized and oriented to reach a position neighbouring said upper latch hole when said separate lid components are mated together in the closed state;

an upper catch button disposed on said upper latch tongue and jutting from a side thereof at a position thereon that aligns with said upper latch hole in said closed state;

wherein said upper latch tongue is resiliently flexible in an upward/downward bending direction that is transverse to said protruding direction, but matches an upwardly/downwardly penetrating direction in which said upper latch hole opens through said first one of the top walls, said upper latch tongue being resiliently biased in an upward direction that biases said upper catch button into the upper latch hole when the separate lid components are mated together, and said upper latch hole is unobstructed at an exterior of said first one of the top walls to permit user depression of the upper catch button, when engaged in said upper latch hole, in a downward direction to thereby disengage the upper catch button from the upper latch hole; and a lateral latch arrangement comprising:

a lateral latch hole penetrating through a first one of the side walls on a first one of the separate lid components; and a lateral latch tongue affixed to a matching first one of the side walls on a second one of the separate lid components and reaching outward from the terminal end of said matching first one of the side walls in the protruding direction from the inner end of said second one of the separate lid components, the lateral latch tongue being sized and oriented to reach a position neighbouring said lateral latch hole when said separate lid components are mated together in the closed state;

a lateral catch button disposed on said lateral latch tongue and jutting from a side thereof at a position thereon that aligns with said lateral latch hole in said closed state;

wherein said lateral latch tongue is resiliently flexible in a lateral bending direction that is transverse to both said protruding direction and said upward/downward bending direction, but matches a laterally penetrating direction in which said lateral latch hole opens through said first one of the side walls on the first one of the separate lid components, said lateral latch tongue being resiliently biased in an outwardly lateral direction that biases said lateral catch button into the lateral latch hole when the separate lid components are mated together, and said lateral latch hole is unobstructed at an exterior of said first one of the side walls to permit user depression of the lateral catch button, when engaged in said lateral latch hole, in an inwardly lateral direction to thereby disengage the lateral catch button from the lateral latch hole, wherein said container has an open top delimited by an upper rim atop which the first and second lid components are configured for installation in collective formation of said combined lid structure in a closed position fully covering said open top of the container.

2. The lid and container of claim 1 wherein each lid component has a recessed groove spanning around the perimeter walls of the lid component on an inner side of said perimeter walls for receiving an outer lip of the container, said recessed groove, in its entirety, residing closer to the open bottom of said lid component than the top wall thereof and residing entirely within an elevational range on said perimeter walls that is delimited between the lateral latch arrangement and the open bottom of the lid component.

3. The lid and container of claim 2 wherein the recessed groove of each lid component, in a lengthwise direction thereof running from the inner end of the lid component to an opposing outer end thereof, angles upwardly away from the open bottom of the lid component toward the top wall thereof.

4. The lid and container of claim 3, wherein said outer lip of the container is defined by the upper rim of the container that spans around the open top thereof, and a polymeric film resides atop said upper rim and spans over the open top of the container.

5. The lid and container of claim 1 wherein said upper latch has its upper latch tongue affixed to the second one of the separate lid components and its upper latch hole defined in the first one of the separate lid components, whereby the second one of the separate lid components is characterized by inclusion of both the upper latch tongue and the lateral latch tongue, and the first one of the separate lid components is characterized by inclusion of both the upper latch hole the lateral latch hole.

6. The lid and container of claim 1 wherein said upper latch tongue affixed to said second one of the top walls is a sole latch tongue of said second one of the top walls.

7. The lid and container of claim 1 wherein said lateral latch tongue affixed to said matching one of the side walls of said second one of the separate lid components is a sole lateral latch tongue of said second one of the separate lid components.

8. The lid and container of claim 7 wherein said second one of the top walls to which the upper latch tongue is affixed is the top wall of the first one of the separate lid components, and said upper latch tongue is a sole latch tongue of said top wall of the first one of the separate lid components.

9. The lid and container of claim 1 wherein said plurality of latch arrangements further comprises a second upper latch arrangement having a second upper latch tongue affixed to the first one of the top walls, a second upper latch hole defined in the second one of the top walls, and a second upper catch button on said second upper latch tongue at a position aligning and engaging with the second upper latch hole in the closed state of the separate lid components, said second upper latch hole being unobstructed at an exterior of said second one of the top walls to permit user depression of the second upper catch button, when engaged in said second upper latch hole, in the downward direction to thereby disengage the second upper catch button from the second upper latch hole.

10. The lid and container of claim 9 wherein said upper latch arrangement and second upper latch arrangement are the sole latch arrangements embodied on the top walls of the separate lid components.

11. The lid and container of claim 1 wherein said plurality of latch arrangements further comprises a second lateral latch arrangement having a second lateral latch tongue affixed to a second one of the side walls on the first one of the separate lid components, a second lateral latch hole defined in a matching second one of the side walls on the second one of the separate lid components, and a second lateral catch button on said second lateral latch tongue at a position aligning and engaging with the second lateral latch hole in the closed state of the separate lid components, said second lateral latch hole being unobstructed at an exterior of said matching second one of the side walls to permit user depression of the second lateral catch button, when engaged in said second lateral latch hole, in a second inwardly lateral direction to thereby disengage the second lateral catch button from the second lateral latch hole.

12. The lid and container of claim 9 wherein said plurality of latch arrangements further comprises a second lateral latch arrangement having a second lateral latch tongue affixed to a second one of the side walls on the first one of the separate lid components, a second lateral latch hole defined in a matching second one of the side walls on the second one of the separate lid components, and a second lateral catch button on said second lateral latch tongue at a position aligning and engaging with the second lateral latch hole in the closed state of the separate lid components, said second lateral latch hole being unobstructed at an exterior of said matching second one of the side walls to permit user depression of the second lateral catch button, when engaged in said second lateral latch hole, in a second inwardly lateral direction to thereby disengage the second lateral catch button from the second lateral latch hole.

13. The lid and container of claim 12 wherein said plurality of latching arrangements consists solely of the upper latching arrangement, the second upper latching arrangement, the lateral latching arrangement and the second lateral latching arrangement.

14. The lid and container of claim 12 wherein said upper latch tongue of the upper latch arrangement is a sole latch tongue of the second one of the top walls, said second upper latch tongue of the second upper latch arrangement is a sole latch tongue of the first one of the top walls, said lateral latch tongue of the lateral latch arrangement is a sole latch tongue of the side walls of the second one of the separate lid components, and said second lateral latch tongue of the second lateral latch arrangement is a sole latch tongue of the side walls of the first one of the separate lid components.

15. The lid and container of claim 1 wherein the first and second lid components are installed in collective formation of said combined lid structure in the closed position fully covering said open top of the container.

16. The lid and container of claim 1 wherein a height of each perimeter wall of each lid component is less than a length of said lid component, as measured from the connecting wall to the unwalled perimeter edge.

17. The lid and container of claim 1 wherein a height of each perimeter wall of each lid component is less than a width of the top wall thereof, as measured between the two side walls.

18. The lid and container of claim 1 wherein the upper latch hole and the lateral latch hole are sized to accommodate fingertip depression therethrough of the upper catch button and the lateral catch button, respectively.

19. A child resistant lid for a container, said lid comprising:

first and second lid components that are separate of one another and void of any permanent attachment therebetween, but are selectively latchable together to cooperatively form said child resistant lid, and that are each sized to cover a respective fraction of an opening of said container, and movable relative to one another between a closed state in which said lid components are mated together to collectively define a combined lid structure sized to cover an entirety of said opening of the container, and an open state in which said lid components are drawn apart from one another to at least partially reveal said opening of the container for access to contents of said container, each lid component comprising a top wall that resides oppositely of an open bottom of the lid component and from which a perimeter wall structure depends downwardly from a perimeter of said top wall;

one or more latch arrangements configured to releasably latch said first and second lid components together in the closed state, and each comprising:

a latch hole defined in a first one of either said first or second lid component; and a latch tongue affixed to a second one of either said first or second lid component and reaching outward therefrom in a protruding direction from an inner end thereof at which said first and second lid components mate together in the closed state, the latch tongue being sized and oriented to reach a position neighbouring said latch hole when said first and second lid components are mated together in the closed state;

a catch button disposed on said latch tongue and jutting from a side thereof at a position thereon that aligns with said latch hole in said closed state, said latch tongue being resiliently flexible in a bending direction that is transverse to said protruding direction, but matches a direction in which said latch hole opens through said first one of either said first or second lid component, said latch tongue being resiliently biased into a default position that biases said catch button into the latch hole when the first and second lid components are mated together, and said latch hole is unobstructed at an exterior of said first one of either said first or second lid component to permit user depression of the catch button, when engaged in said latch hole, in the bending direction to thereby disengage the catch button from the latch hole; and among said one or more latch arrangements, at least one lateral latch arrangement whose latch hole is defined in a side wall of the perimeter wall structure of said first one of either said first or second lid component, and whose latch tongue is affixed to a matching sidewall of said second one of either said first or second lid component;

a recessed groove spanning around the perimeter wall structure of each lid component on an inner side of said perimeter wall structure for receiving an outer lip of the container, said recessed groove, in its entirety, residing closer to the open bottom of said lid component than to the top wall thereof.

20. The lid of claim 19 wherein the recessed groove of each lid component, in a lengthwise direction thereof running from the inner end of the lid component to an opposing outer end thereof, angles upwardly away from the open bottom of the lid component toward the top wall thereof.

21. The lid of claim 20 in combination with the container, wherein said outer lip of the container is defined by an upper rim of the container that spans around an open top thereof, and polymeric film resides atop said upper rim and spans over the open top of the container.

22. The lid of claim 19 wherein the recessed groove resides entirely within an elevational range on said perimeter wall structure that is delimited between the at least one lateral latch arrangement and the open bottom of the lid component.

* * * * *